United States Patent [19]

Bowman et al.

[11] Patent Number: 4,948,114

[45] Date of Patent: Aug. 14, 1990

[54] METHOD AND APPARATUS FOR HANDLING LEAVES OF SHEET MATERIAL

[75] Inventors: Kenneth A. Bowman; John D. Rolfe, both of Bristol, England

[73] Assignee: DRG (UK) Limited, Avon, England

[21] Appl. No.: 272,856

[22] Filed: Nov. 18, 1988

[30] Foreign Application Priority Data

Nov. 19, 1987 [EP] European Pat. Off. ..... 87117064.3

[51] Int. Cl.[5] ..... B65H 29/18

[52] U.S. Cl. ..... 271/202; 271/270; 271/271

[58] Field of Search ..... 271/270, 271, 202, 203

[56] References Cited

U.S. PATENT DOCUMENTS

| | | | |
|---|---|---|---|
| 1,421,569 | 7/1922 | Ritchie | 271/271 |
| 3,153,533 | 10/1964 | Novick | 271/271 X |
| 4,313,600 | 2/1982 | Mosburger | 271/270 X |
| 4,585,227 | 4/1986 | Müller | 271/270 |
| 4,598,901 | 7/1986 | Thomas | 271/270 X |

FOREIGN PATENT DOCUMENTS 2917250 10/1980 Fed. Rep. of Germany ..... 271/202

*Primary Examiner*—Richard A. Schacher
*Attorney, Agent, or Firm*—Larson and Taylor

[57] ABSTRACT

The apparatus comprises two parallel and spaced apart conveyor belts and a toothed take-along belt guided parallel to and interposed between the two conveyor belts. The take-along belt has a thickened or otherwise rigidified section providing an engagement region. The belt runs at constant speed, faster than the conveyors. The engagement region runs slightly beneath the conveying surface of the conveyors until it reaches an engagement location, at which it may halt and then be instantaneously raised and restarted in response to a signal indicating an adjacent batch or leaves to lift the leaves off the conveyor belt and cause them to be moved with greater velocity than the conveyor belts to the delivery end thereof where they are stacked.

18 Claims, 5 Drawing Sheets

METHOD AND APPARATUS FOR HANDLING LEAVES OF SHEET MATERIAL

BACKGROUND OF THE INVENTION

The invention relates to a method and an apparatus for handling leaves of sheet material, for instance folded signatures, which are guided successively along a conveyor path and separated into partial streams. At the end thereof they may be formed into a stack.

Known handling and stacking apparatus can generally only process one sheet size since the stack is bordered at the ends by a plate. If the size of the plate differs substantially from the size of the sheets the sheets can be damaged when tying the stack. The field of use of such systems is thus limited. Furthermore, the stacks produced are long and heavy.

It is also known to produce smaller stacks and to handle these manually. In this method the speed of handling must be extremely high since the stacks are removed from the sheets which are being continuously conveyed.

It is desirable to make a sufficient period of time available for the handling of such stacks which are formed from a continuously moving flow of sheets.

Techniques for separating a stream of sheet material into partial streams, spaced apart so that they arrive at handling stations at spaced time intervals, are known. It is well known to interpose a barrier intermittently to create gaps. But this leads to disruption of the array sheets retained by the barrier, making their subsequent handling difficult and possibly damaging them. It does not permit precise quantities of material to be separated.

U.S. Pat. No. 4265443 discloses the use of two conveyors in succession. The first is telescopic so that the location on the second conveyor where it deposits material is variable. Both conveyors are periodically accelerated and decelerated in use. Overall this is complex and inconvenient, and does not allow precise quantities of material to be separated without disruption of the array.

GB-A-2127381 discloses a signature conveyor with a continuous chain running in parallel adjacent part of its conveying run. A length of the chain bears signature engaging lugs. A group of signatures is retained by indexing the chain so that the lugs lift signatures off the conveyor. Following signatures pile up from the rear, until the chain is moved again, returning the signatures to the conveyor. This disturbs the array of signatures and does not allow precise quantities of material to be separated. GB-A-2139991 discloses a first conveyor that feeds a second conveyor. Associated with the first conveyor is a continuous loop whereof a length is thickened such that when this portion is adjacent the conveyor, it projects above the conveying surface to lift sheets off it. Initially, the conveyors and the loop are driven at the same speed. Once the thickened portion has lifted a length of signatures, the loop and the second conveyor are accelerated. Thus a batch of sheets is deposited on the second conveyor and spaced from the following sheets. This is disadvantageous in that it does not enable the batches to be precisely predetermined.

SUMMARY OF THE INVENTION

According to the present invention there is provided apparatus for handling leaves of sheet material, including conveyor means for transporting successive leaves to the delivery end thereof; there being at least one take-along mechanism comprising a rotatable take-along belt with at least one engagement region which is guided adjacent a conveying region of the conveyor means; said engagement region being adapted to engage leaves on a length of the conveyor means and cause said leaves to be moved with a different velocity from that of the conveyor means; characterised in that displacement means are provided whereby said engagement region is displaceable transverse to its running direction so as to engage said leaves. Generally the engagement region is guided substantially parallel to the conveyor means, and carries leaves to the delivery end of the conveyor at a greater speed than the conveyor.

The apparatus may include a stacking station and/or at least one extension conveyor means leading to a stacking station, and serve to introduce a spacing between the last leaf of the stack currently being produced and the first leaf of the subsequent stack. The size of the spacing determines the period of time which is available for the tying, removal and other handling of the finished stack. The conditions can be so selected that a relatively large period of time is available with respect to the stacking cycle. This is of importance, for instance when stacking folded signatures. The signatures do not lie anything like as flat as individual leaves and thus form non-uniform stacks whose handling requires a greater length of time.

Furthermore, relatively small numbers of leaves may be collected together which can then be manually stacked.

In the circumstances it is of considerable importance that no alteration in the leaf delivery should occur.

If all leaves belonging to each stack are commonly guided along the end section of the conveyor path with a greater velocity than the subsequent leaves, the amount of mutual overlapping of successive leaves can be kept constant.

Preferably the belt is adapted to be driven intermittently. Thus it can be adapted to halt at a "home" position from which it can be displaced transversely to engage the leaves, and rapidly driven off. The belt may be toothed. There may be a projecting dog at the trailing end of the engagement region for engaging the last leaf or signature to be accelerated in that cycle.

In preferred embodiments, the rotating take-along belt has at least one thickened or rigidified section providing a said engagement region which may be guided parallel to the conveyor means in such a manner that only the engagement region engages the leaves. This offers an extremely simple and exact possibility of accelerating predetermined numbers of leaves cyclically one after the other, particularly when used in conjunction with optical/mechanical counting means. Thus a plurality of stacks can be created per revolution of the take-along belt. The length of the take-along belt and its velocity determine the period of the cycle.

The thickened section of the take-along belt preferably projects in the manner of a step. Alternatively the trailing edge may be shaped as a relatively steep ramp. A precisely defined boundary is thus formed for the transfer of the leaves. Desirably this is enhanced by a projecting dog.

It has been found that the thickened section is advantageously constructed at least twice as thick as the remainder of the take-along belt. This reliably ensures that the leaves are transferred by the thickened section and are not influenced by the other sections.

Since the engagement region of the take-along belt is movable against the leaves transverse to its running direction, the thickened or rigidified section of the take-along belt which is to be used may be brought instantaneously into use over its entire length and in synchronism with the cycle of the take-along belt. All the leaves to be accelerated are thus engaged simultaneously. (It may sometimes be preferable for the engagement region to be angled slightly relative to the conveyor, so that there is a gradual take-up of leaves.)

This movability of the take-along belt may be achieved constructionally in a particularly simple manner if the engagement region of the take-along belt guided parallel to the conveyor means extends along a transversely displaceable track or support. The track can be moved relative to the plane of action of the take-along belt back and forth by any desired means, for instance by pneumatically actuated working piston machines. (A pair of pistons can be individually controlled to allow variable angling of the engagement region.)

For reasons of space or other constructional reasons it can be preferable if the conveyor means has at least two parallel and spaced apart conveyor belts and if the engagement region of each take-along belt is guided parallel to and interposed between two conveyor belts at substantially the same level as the conveyor means. In use, the engagement region of the take-along belt lifts the leaves to be accelerated above the plane of the conveyor means and transports them to its delivery end.

In an alternative type of embodiment, the take-along belt is disposed above the conveyor means which is constructed as belt conveyor. The leaves are moved in a simple manner above the moving belt conveyor towards its delivery end during their acceleration.

In both types of embodiment, there is equally the possibility of both horizontal and vertical stacking.

When handling signatures the following problem arises. The output of the production devices generally of necessity permits an incomplete stack to be formed in every production cycle. If this is formed at the beginning of a series of stacks disruptions occur in the course of the further processing; however, at the end of a series of stacks it is not disruptive. Embodiments of the invention enable one to ensure that the incomplete stack is formed at the end of the series of stacks, i.e. that the first stack of the series is complete. For this purpose the take-along mechanism is drivable via a clutch/DC drive with suitable braking means with a predetermined position of engagement. When a series of stacks is finished and the conveyor means is emptied, then at the start of the subsequent series of stacks the take-along mechanism is only set in movement in a predetermined position when the first signature of the started production cycle has reached a predetermined position.

It can also happen that a faulty group of signatures is produced in the middle of a run and has to be scrapped. It is thus useful to be able to re-set the synchronisation when part of a stack has been lost.

If a stacking device is connected this is also driven in similar manner as above with the predetermined position of engagement. When stacking by hand a normal drive is sufficient.

The stacking station (when present) may comprise support means for collecting the leaves and means for providing relative motion between the support means and at least one of said conveyor means and (if present) conveyor extension means. Preferably, the support means and at least one of the conveyor means and conveyor extension means are movably mounted. For suiting the thickness of the leaves, the speed of motion may be adjustable.

The stacking station may have a retractable back stop whose position is adjustable to suit the length of the leaves. There may be guide plates extending along the conveyor means as well as at the sides of the stacking station for ensuring an even line at the edges of the leaves. The stacking station may comprise an ejector whose stroke is such that it is capable of ejecting the longest leaves.

In a second aspect the invention provides a method of handling leaves of sheet material comprising conveying them along a conveyor means at a first speed, and providing a rotating take-along belt having at least one engagement region which is guided adjacent a conveying region of the conveyor means to enable the engagement region to engage leaves on the conveyor means; characterised in that said belt is caused to run at a second speed greater than said first speed; said belt being arranged so as to be spaced from the leaves on the conveyor means until the engagement region is in a predetermined engagement configuration, where it is displaced transversely to its running direction to engage said leaves.

DESCRIPTION OF THE PREFERRED EMBODIMENTS

Figure 1:
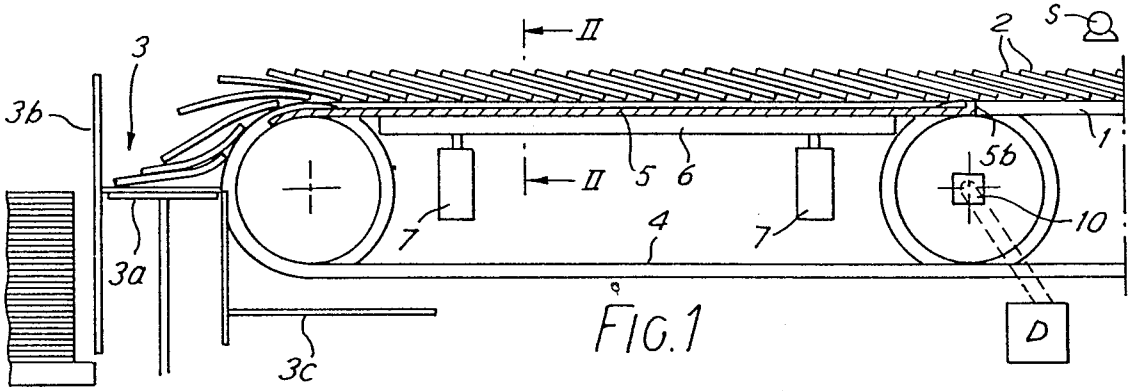
FIG. 1 is a schematic vertical longitudinal section through a first embodiment with the take-along mechanism inactive.
Figure 3:
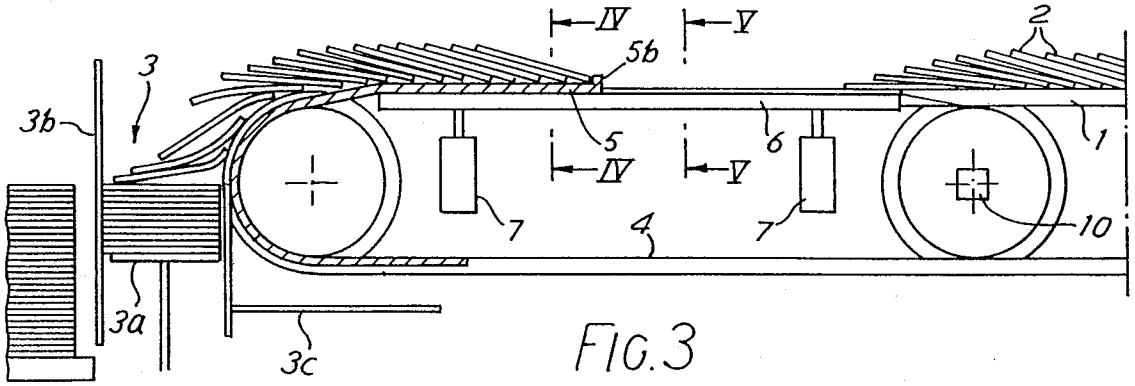
FIG. 3 is a section corresponding to FIG. 1 with the take-along mechanism active.

The apparatus of FIGS. 1 and 3 includes a conveyor 1 which transports signatures 2 from a not illustrated production device to a stacking station 3. A take-along mechanism is further provided which includes a toothed take-along belt 4 which has a thickened section 5 providing an engagement region 5*a*. At the trailing end of the section 5 there may be a driving dog 5*b*. This is a moulded element of plastics (e.g. Nylon) about 6 mm thick, which projects about 6 mm above the rest of the section 5 (see FIG. 9*a*). The take-along belt 4 extends along a track 6 which can be raised and lowered by pneumatic working piston machines 7. The area illustrated corresponds to the end section of the conveyor 1.

Figure 2:
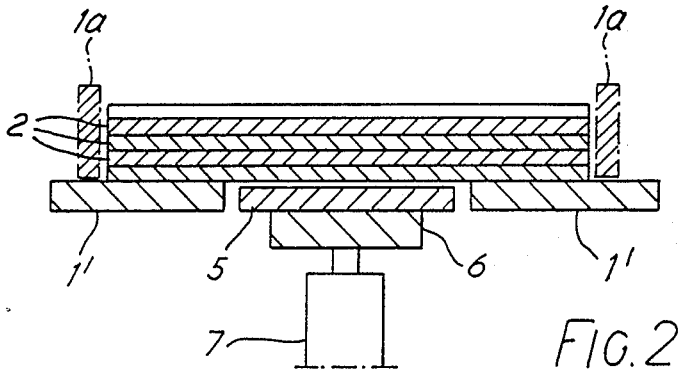
FIG. 2 is a section along the line II—II in FIG. 1, but on a larger scale.
Figure 4:
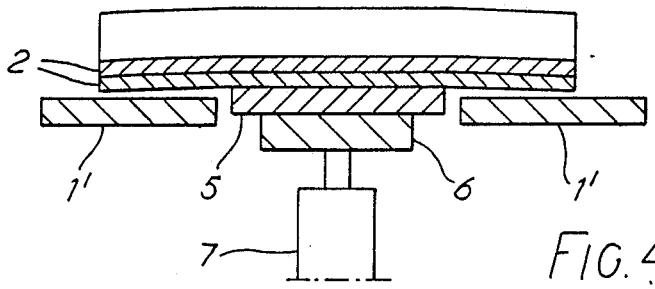
FIG. 4 is a section along the line IV—IV in FIG. 3, but on a larger scale.
Figure 5:
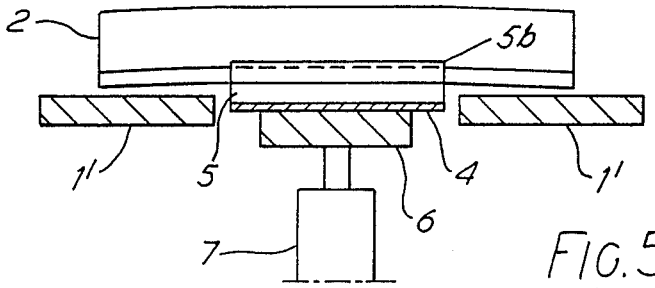
FIG. 5 is a section along the line V—V in FIG. 3, but on a larger scale.

It may be seen from FIGS. 2, 4 and 5 that the conveyor 1 comprises two conveyor belts 1' which receive the take-along belt 4 with its thickened section 5 between them.

In FIG. 2 the track 6 is lowered. The thickened section 5 and dog 5b thus do not contact the signatures 2.

In FIG. 4, on the other hand, the track 6 is raised. It thus presses the thickened section 5 upwardly so that it engages the associated signatures 2 with an engagement region 5a (FIG. 6) and lifts them above the level of the conveyor belts 1'. The track 6 underlies most of the engagement region 5a, though that region is longer than the track so that in the FIG. 1 configuration it extends beyond the track 6 at front and rear. However it is sufficiently rigid to be lifted in its entirety by raising the track 6. NB The belt 4 rotates constantly with a linear speed greater than that of the conveyor 1. When the engagement region 5a is positioned precisely as shown in FIG. 1, it can be almost instantaneously raised by means of the piston machines 7. A precisely determined batch of signatures 2 is thus raised and accelerated. Thus a space forms between the engaged signatures, which form at least the end of the stack being formed, and the subsequent signatures, with which the next stack is begun, as can be seen from FIG. 3. The size of the spacing is determined by the length and the running velocity of the engagement region of the take-along belt 4 relative to conveyor belt 1. The spacing means that a period of time, which may be quite large, is available for the handling of the finished stack before the next stack is begun. It will be noted that the accelerated signatures are not disarrayed or exposed to the risk of damage.

After the engagement region 5a has left the track 6, the track is lowered until the engagement region 5a is again in the FIG. 1 configuration.

The subsequent signatures can continue their movement on the conveyor until they too are engaged by the engagement region 5a of the thickened section 5 of the take-along belt 4. The take-along belt 4 itself is so thin that it does not reach the level of the conveyor belts 1' even when the track 6 is raised, see FIG. 5. This is promoted by the thickness relationship between the thickened section 5 and the take-along belt 4, about 3:1 in the present case.

Figure 9B:
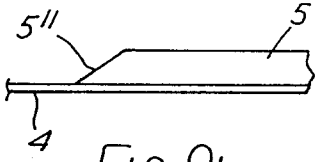
FIGS. 9*a* and 9*b* are details in longitudinal section of alternative forms of engagement portions of the take-along mechanism.
Figure 9A:
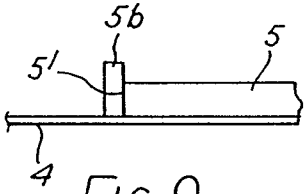

As may be seen in FIGS. 1, 3 and 9a, the contact surface of the thickened section 5 is offset with respect to the rest of the take-along belt 4 in the manner of the step 5'. Thus the position is the flow of signatures at which the transfer of said signatures by engagement of the thickened section 4 begins is determined very precisely.

FIGS. 1 and 3 show also a support 3a collecting the leaves 2. In this embodiment, the support 3a is lowered during the collection of a complete stack. The velocity of the lowering motion can be adjusted to the thickness of the leaves. After a stack has been completed, a back stop 3b is retracted and an ejector 3c is operated for removing the stack out of the stacking station area. The stroke of the ejector 3c is long enough to eject the longest leaves. The position of the retractable back stop 3b is adjustable to suit the length of the leaves.

In FIG. 2, guide plates 1a which are shown only diagrammatically are provided along the conveyor 1. They are adjustable and ensure an even line at the edges of the leaves.

Figure 6:
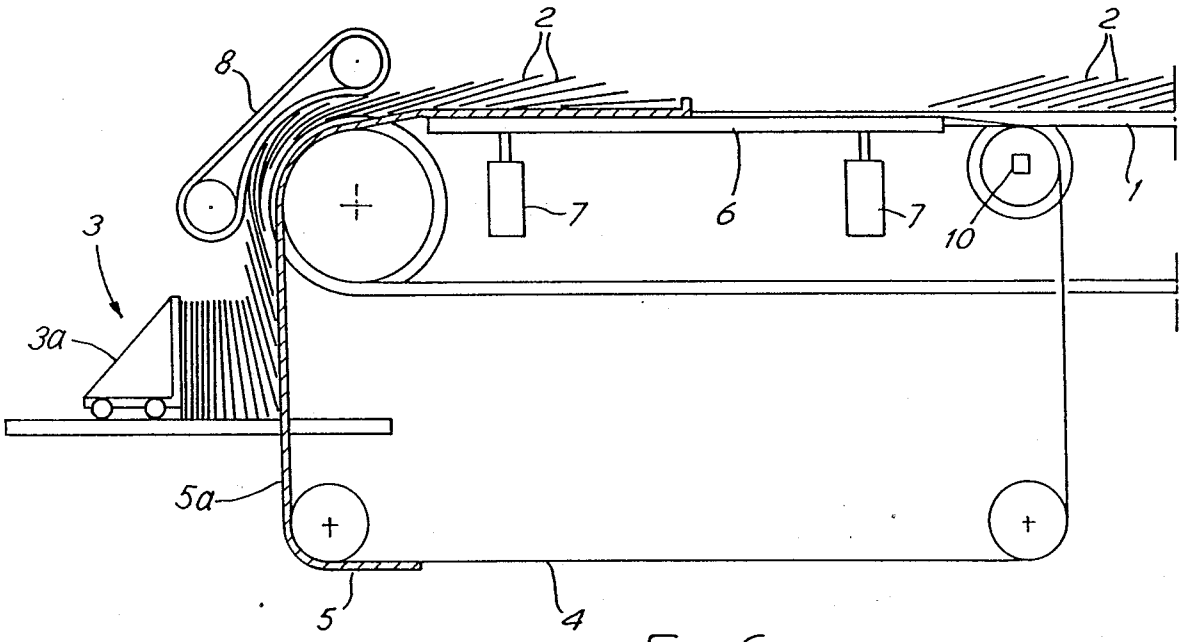
FIG. 6 is a schematic vertical longitudinal section through a second embodiment.

In the embodiment shown in FIGS. 1 and 3 the signatures are stacked horizontally. By way of contrast, FIG. 6 shows an embodiment in which the signatures are stacked vertically. In order to render this possible a support belt 8 is provided at the turn-round point of the conveyor 1 and take-along belt 4. The support 3a is moved horizontally in this embodiment.

Common to the embodiment of FIGS. 1 and 3 and of FIG. 6 is that the upper segment of the take-along belt 4 is disposed slightly below the level of the upper segment of the belt-conveyor 1 and raised in order that the engagement region 5a of the thickened section 5 can engage the leaves.

Figure 7:
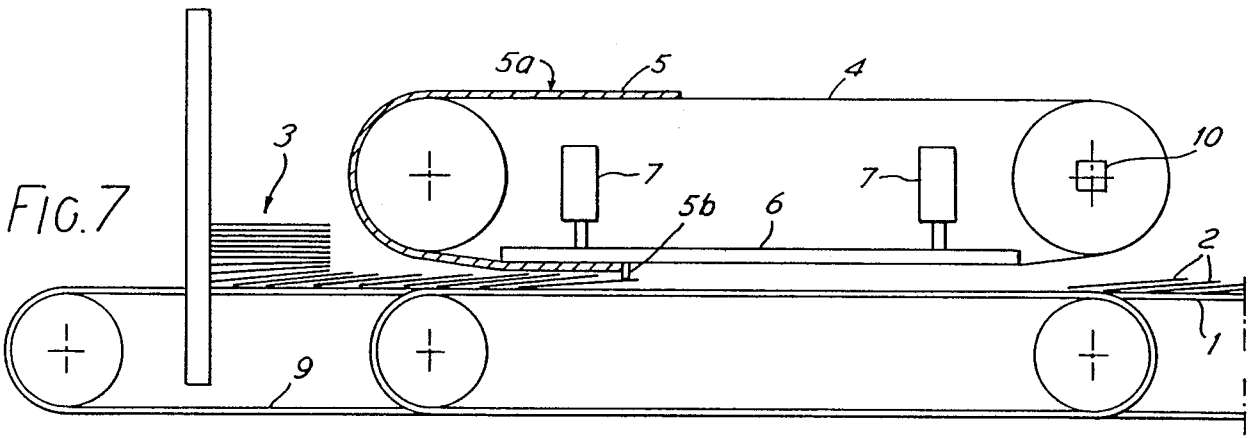
FIG. 7 is a schematic vertical longitudinal section through a third embodiment.

FIG. 7 shows an alternative with the reverse arrangement. In this the take-along mechanism 4—7 is disposed above the conveyor 1 and the track 6 is lowered when the thickened section 5 of the take-along belt 4 is to engage the signatures 2.

In FIG. 7 the stacking station 3 is arranged a distance behind the delivery end of the conveyor 1. An extension conveyor 9 moving with the same velocity as the take-along belt 4 is provided for transporting the leaves 2 to the stacking station.

Figure 8:
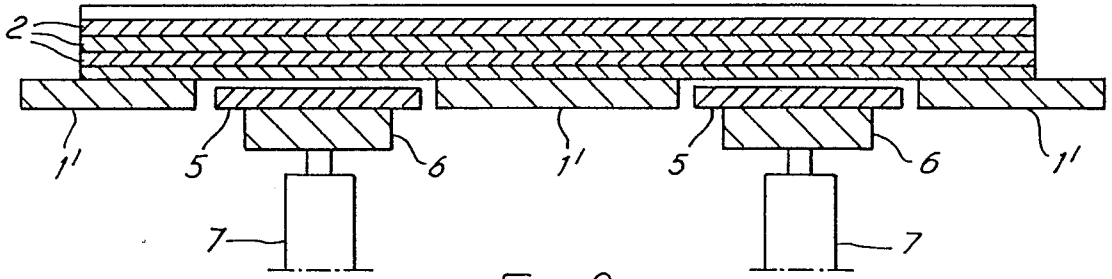
FIG. 8 is a section similar to that of FIG. 2, showing a fourth embodiment.

In the embodiment of FIG. 8, three conveyor belts 1' are provided and two take-along belts are interposed between the conveyor 1', each having a thickened section 5. This embodiment is suitable for handling large leaves or signatures.

The take-along belt 4 is driven by driving means (schematically indicated at D in FIG. 1) via a clutch 10 with a predetermined position of engagement. The clutch 10/drive D combination ensures that at the start of a stacking cycle the first stack is complete. The take-along belt 4 is only put into motion when a sensor (schematically indicated at S in FIG. 1) indicates that the signatures intended for the first stack have reached a predetermined position.

Figure 10:
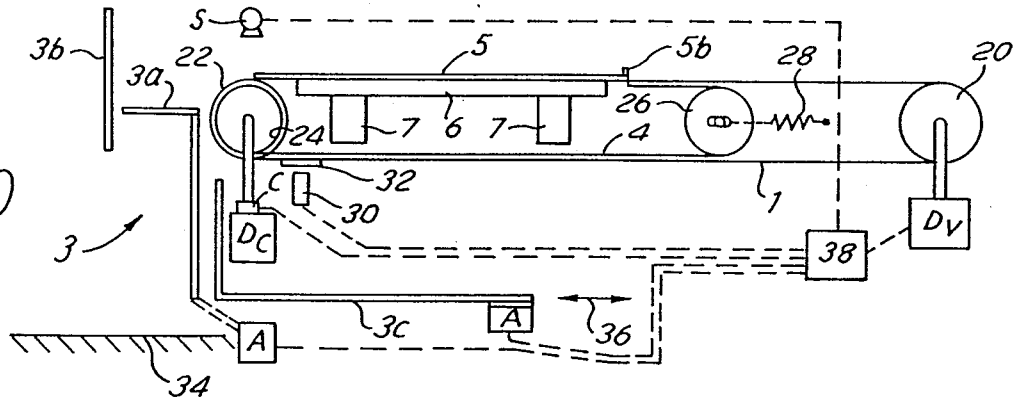
FIG. 10 is a schematic vertical longitudinal section through a third embodiment.

The embodiments described so far are intended to be operated with the conveyor and take-along belt running at constant (but different) speeds. Thus both the conveyor and the belt may be driven from a single motor, through different gearing. In contrast, FIG. 10 shows an apparatus which has two separate drives: a variable drive $D_V$ for the conveyor 1 and a constant speed intermittent drive $D_C$ for the toothed belt 4.

The apparatus is in many respects the same as that shown in FIGS. 1 to 5, and corresponding elements are given the same reference numerals.

The conveyor 1 runs from a driven roller 20 to an idler roller 22 at the delivery end. The toothed belt 4 runs from a driven roller 24 to an idler roller 26 at the upstream end. This idler roller 26 is mounted so as to be displaceable towards the driven roller 24, against the force of a return spring 28. This facilitates the upward displacement of the track 6.

The drive $D_V$ to the conveyor 1 is variable to alter the conveyor's speed. This can be used to alter the number of signatures per unit length of the conveyor 1 (if they are supplied at a given rate), and hence the number in a batch engaged by the thickened region 5 of the belt 4.

The drive $D_C$ to the toothed belt 4 is switchable (e.g. by means of a clutch and brake C) so that the belt 4 can be rapidly accelerated to a predetermined speed (substantially greater than the maximum speed of the conveyor 1), and rapidly halted at a desired configuration.

The belt 4 passes adjacent a detector 30 which detects one or more accurately predetermined configurations of the belt 4. Thus it may employ a sensing switch device to detect a metal plate 32 on the belt 4. This detection is used to control the motion of the belt 4 to stop it with the thickened section 5 underlying the conveying section of the conveyor 1 adjacent its delivery end.

A sensor S detects when signatures arrive at the delivery end. This triggers actuation of the piston 7 to raise the track 6 and the section 5, to lift a precisely determined batch of signatures. It also triggers the constant drive $D_C$, so that the lifted signatures are rapidly conveyed off the assembly. They meet the backstop 3b and fall onto delivery forks 3a.

When the belt 4 has rotated until the dog 5b is adjacent the sensor S, this is detected (e.g. by means of the sensor S or by the detector 30 sensing another marker on the belt), and triggers retraction of the pistons 7 so that the track 6 descends. Thus when the thickened section 5 is again over the track 6 (and the belt 4 is then stopped as described above), the section 5, including the dog 5b, is out of contact with passing signatures.

The detection of the arrival of signatures by the sensor S also causes the delivery forks 3a to descend, and this continues while the belt 4 rotates through one cycle. The signatures reach a fixed table 34. The ejector 3c, displaceable as shown by arrow 36, then moves to push a stack of signatures to a wrapping area. The ejector 3c retracts, and the forks 3a rise to the initial position, awaiting delivery of the next batch of signatures by the next displacement of the belt 4.

The various operations may be controlled by a control computer 38 that receives data from the sensor S and detector 30, and automatically actuates the constant drive $D_C$ and actuators A for the delivery forks 3a and ejector 3c. It may also allow manual control of the variable drive $D_V$.

A plurality of modifications are possible within the scope of the present invention. E.g. the thickened section 5 of the take-along belts 4 may end at the trailing edge in a relatively steep ramp 5'' as shown in FIG. 9b rather than project in the manner of a step. Furthermore, the guide plates 1a of FIG. 2 may be readily provided also as a part of the stacking station. Instead of lowering the support 3a of FIGS. 1 and 3, the conveyor 1 and its associated components may be raised during the collection of a stack. As an alternative, the support 3a may be lowered and the conveyor 1 raised simultaneously. Instead of three conveyor belts 1' with two take-along belts interposed as shown in FIG. 8, as many sets as feasible can be provided.

Whereas the invention has been described with reference to the preferred embodiments, these are given only by way of example. The skilled reader will appreciate that numerous modifications and variations are possible within the spirit and scope of the invention, and it is intended to cover all such modifications and variations by the accompanying claims.

We claim:

1. Apparatus for handling leaves of sheet material, said apparatus comprising conveyor means for transporting successive leaves to the delivery end thereof; at least one take-along mechanism comprising a rotatable take-along belt with at least one engagement region, which is guided adjacent a conveying region of the conveyor means, for engaing leaves on a length of the conveyor means and for causing said leaves to be moved with a different velocity from that of the conveyor means so as to separate said leaves from succeeding leaves; and displacement means for displacing said engagement region transverse to the direction of movement thereof so as to engage said leaves.

2. Apparatus according to claim 1 wherein the engagement region is guided substantially parallel to the conveyor means and is adapted to carry leaves to the delivery end thereof at a greater speed than the conveyor means.

3. Apparatus according to claim 1 wherein said displacement means and engagement region are arranged so that an engagement region of predetermined length is displaceable transverse to the conveyor means at a predetermined region thereof.

4. Apparatus according to claim 3 wherein said engagement region is provided by a relatively rigid portion of the belt, and the displacement means comprises a support and means for displacing the support when the engagement region is adjacent thereto, whereby the engagement region is displaceable simultaneously in its entirety.

5. Apparatus according to claim 1 wherein the engagement region of the take-along belt has a projecting drive dog at its trailing end.

6. Apparatus according to claim 1 wherein said belt has at least one thickened section forming said engagement region which projects beyond the rest of the belt so that only the engagement region is engageable with the leaves.

7. Apparatus according to claim 6 wherein the thickened section is at least twice as thick as the remainder of the take-along belt or the root thereof if the belt is toothed.

8. Apparatus according to claim 1 wherein the conveyor means has at least two parallel and spaced apart conveyor belts and the engagement region of each take-along belt is guided parallel to and interposed between two said conveyor belts.

9. Apparatus according to claim 1 wherein the conveyor means is constructed as a belt conveyor and the take-along belt is disposed at a level above the belt conveyor.

10. Apparatus according to claim 1 further including a stacking station for receiving batches of leaves and producing stacks therefrom and wherein the engagement region is adapted to engage at least the last leaves belonging to each stack.

11. Apparatus as claimed in claim 10 wherein the engagement region engages at the same time all of the leaves belonging to a respective stack.

12. The apparatus according to claim 10 further including at least one extension conveyor means leading from the main conveyor to said stacking station.

13. Apparatus according to claim 12 wherein the stacking station comprises support means for collecting the leaves and means for providing relative motion between said support means and at least one of said conveyor means and conveyor extension means.

14. Apparatus as claimed in claim 13, wherein the support means and at least one of the conveyor means and the conveyor extension means is movably mounted.

15. Apparatus according to claim 1 further comprising means for halting the belt with the engagement region in a precise configuration adjacent the conveying region of the conveyor means, then displacing the engagement region to engage said leaves and restarting the rotation of the belt to move away the engaged leaves.

16. Apparatus according to claim 1 wherein the conveyor means is operable at variable speed to control the number of sheets per unit length.

17. A method of handling leaves of sheet material comprising conveying them along a conveyor means, and providing a rotating take-along belt having at least one engagement region which is guided adjacent a conveying region of the conveyor means to enable the engagement region to engage leaves on the conveyor means; said belt being caused to run at a velocity different from the velocity of the conveyor means; said method further comprising arranging said belt so as to be spaced from the leaves on the conveyor means until the engagement region is in a predetermined engagement configuration and, when said engagement region is in said predetermined engagement configuration, displacing said engagement region transversely to the running direction thereof so as to engage said leaves.

18. A method according to claim 17 wherein the belt is halted with the engagement region in the engagement configuration but spaced from the leaves until a signal causes said transverse displacement and restarts running of the belt.

* * * * *